US006435760B1

(12) United States Patent
Pettesch

(10) Patent No.: US 6,435,760 B1
(45) Date of Patent: Aug. 20, 2002

(54) QUICK RE-INSTALL BUMPER GUARD SYSTEM AND METHOD

(75) Inventor: Martin C. Pettesch, Cranford, NJ (US)

(73) Assignee: Universal Valve Co., Inc., Elizabeth, NJ (US)

( * ) Notice: Subject to any disclaimer, the term of this patent is extended or adjusted under 35 U.S.C. 154(b) by 0 days.

(21) Appl. No.: 09/416,591

(22) Filed: Oct. 12, 1999

(51) Int. Cl.[7] ..... E01F 15/00
(52) U.S. Cl. ..... 404/6; 264/338
(58) Field of Search ..... 49/33, 49; 404/6, 404/9; 264/31, 337, 338; 256/59, 64, 1, 13.1, 338

(56) References Cited

U.S. PATENT DOCUMENTS 244,112 A * 7/1881 Clute ..... 256/13.1
3,584,839 A * 6/1971 Dickey ..... 256/65
3,787,033 A * 1/1974 Snyder et al. ..... 256/59
4,015,827 A * 4/1977 Brand ..... 256/59
4,045,003 A * 8/1977 McCluskey ..... 256/59
4,190,379 A * 2/1980 Toro Sosa et al. ..... 404/6
5,167,093 A * 12/1992 Hamilton ..... 404/6
5,372,676 A * 12/1994 Lowe ..... 264/338
5,709,739 A * 1/1998 Wittich et al. ..... 264/338
5,902,528 A * 5/1999 Spragg ..... 264/338

* cited by examiner

*Primary Examiner*—Thomas B. Will
*Assistant Examiner*—Raymond W Addie
(74) *Attorney, Agent, or Firm*—Edward Dreyfus

(57) ABSTRACT

A U-shaped bumper guard system for gas stations, parking and other vehicular areas and the like that enables easy removal of a damaged bumper guard and re-installation of a replacement guard without the need to cut or dig the concrete around the damaged guard legs that are secured in the foundation concrete. Features include securing tubular base members positioned upright in the concrete foundation layer, applying a liner within each base member, positioning one leg of the U-shaped guard into each base, and pouring concrete or the like into the liner and in contact with the leg outer surface. The liner prevents adherence between the concrete and the inner surface of the base member so that if damaged, the unit and base member concrete can be easily raised free from the base member and replaced with a new bumper guard, liner, and securing concrete since neither the foundation layer nor the base members are damaged or moved. If desired, the tubular bases can be pre-secured to the guard legs with the liner and base concrete in place prior to the bases being secured in the foundation concrete for initial installation.

12 Claims, 6 Drawing Sheets

QUICK RE-INSTALL BUMPER GUARD SYSTEM AND METHOD

BACKGROUND

The present invention relates to U-shaped bumper guards and systems, more particularly to concrete imbedded U-shaped bumper guard for fueling stations, parking areas, and other vehicular areas and methods of installing and reinstalling such guards.

A vast variety of post footing designs have existed since the Roman Empire invention of concrete about 1800 years ago. Today, post footing designs are about the same as then, i.e. a rock bed of various sized layered stone is established, a post is set upright on the bed surface, concrete is poured to a predetermined roadway or foundation height. The concrete binds to the post during curing thus locking the post upright in the concrete foundation. Some posts are provided with flanges, vertical ribs, spiral ribs, horizontal plates, or other features designed to aid in holding the post upright, enhancing the concrete to metal or concrete-to-wood bond, or resisting the loosening or movement of the post after installation due to thermal expansion and contraction.

Although these systems work satisfactory for a permanent post installation, a problem exists in the event the post is damaged or otherwise needs replacement by a new or replacement post of the same or different horizontal cross section size and shape.

For example, if a concrete mounted post is damaged, the present conventional practice includes using diamond circular saws to cut into the concrete a closed groove, commonly in a square shape, about the post location. Jack hammers or manual sledges are used to break-up the concrete within the groove loci. The post and broken concrete parts are removed. The resulting hole is cleaned and bedrock adjusted or augmented as necessary. Then, a new concrete setting is mixed, the new post positioned, measured and aligned with the post installed upright with temporary supports holding the post aright. Then the new concrete is poured and top surface smoothed. In addition, the new concrete material must be tended by the installer, particularly on hot summer days, to water as necessary so that the concrete does not dry too quickly. Good practice includes covering the surface of the setting concrete to retard this drying process. Usually, the installer must return the following day to remove support forms and coverings. This process is grossly consuming in person power, time, materials, and tools. In the event the post is damaged again, the entire process must be repeated, and it is well known that posts are frequently damaged in areas where vehicles maneuver such as above and below ground parking lots, gas stations, industrial fueling stations, etc. In the case of gas stations, the U-shaped concrete imbedded bumper guards are particularly troublesome because each bumper guard includes two legs that must be reinstalled in the manner described.

SUMMARY OF EXEMPLARY EMBODIMENTS

The present invention has as its main objective the provision of a system that avoids all the aforementioned problems and that provides for the quick, efficient installation and reinstallation of U-shaped bumper guards without the need to cut and break-up concrete.

One exemplary embodiment according to the principles of the present invention includes securing tubular base members positioned upright in the concrete foundation layering, applying liner within each base member, positioning one leg of the U-shaped guard into each base, and pouring concrete or the like into the liner and in adhering contact with the leg outer surface. The liner prevents adherence between the concrete and the inner surface if the base member. Once the concrete within the base sets, the installation is complete. It will be understood that the liner prevents the base concrete from binding to the base inner side walls.

After installation, if the bumper guard is damaged or needs replacement, a single person can simply raise the post footing and the small amount of base concrete adhering to the legs. Advantageously, the damaged upper part of the leg can be cut-away at a point, E.G., one foot above the support to enable better handling of the post footing. The liner will exit along with the base concrete. The foundation concrete remains undisturbed.

Since the base remains undamaged and remains installed in the foundation concrete, reinstallation of a new post simply involves the following;

1. install a new replacement liner,
2. install a replacement guard leg in each liner and base which has not moved,
3. mix and pour new base concrete into each liner/base.

DRAWINGS

Various other objects, features, and benefits of the present invention shall become apparent with the following detailed description when taken in view of the appended drawings in which.

DETAILED DESCRIPTION

Figure 1:
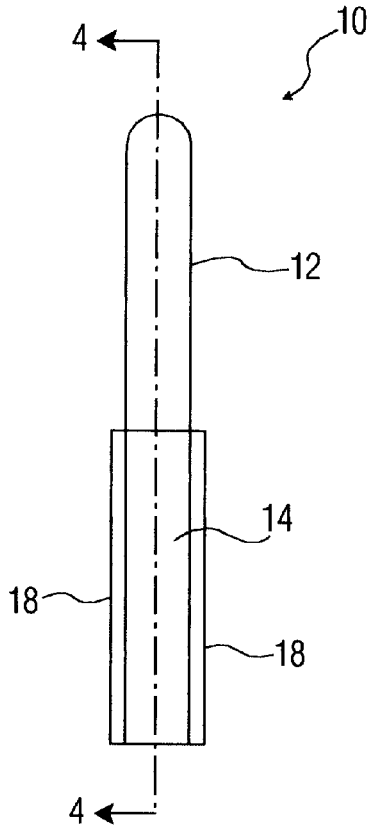
FIG. 1 is a side elevation of one exemplary embodiment of the bumper guard system according to the principles of the present invention.
Figure 2:
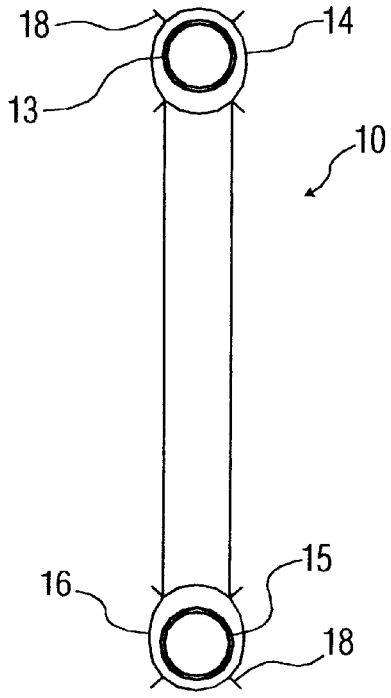
FIG. 2 is a bottom view of the system of FIG. 1.

With reference to FIGS. 1 through 5 a bumper guard system 10 according to the principles of the present invention includes a U-shaped steel bumper guard 12 having a pair of vertically disposed legs 13, 15 and a central horizontal section 11, generally as shown. Guard 12 can be made of any suitable material such as steel, aluminum, or heavy plastic and can have any suitable cross section such as round, oval, square, etc. Typically, guard 12 comprises 3½" or 4" steel pipe with circular cross section.

Figure 6:
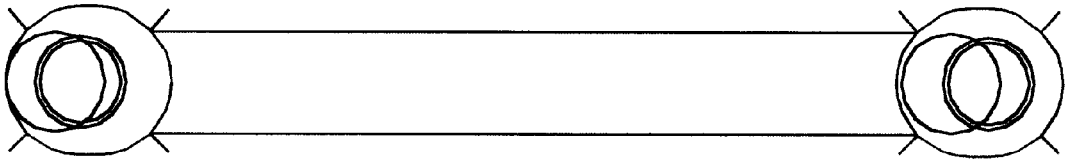
FIG. 6 is similar to FIG. 2 showing an alternate system embodiment according to the present invention.

System 10 further includes a bumper guard tubular base 14, 16 mounted at the distal ends of jegs 13 and 15, respectively. Each base 14, 16 has a vertical height equal to or slightly greater than the design thickness of the concrete foundation 100 onto which it is to be secured. The bottom of the base 14, 16 can be opened, as shown, or closed with an end-plate or foot (e.g., FIG. 8), as desired. Base 14, 16 can have any suitable cross section such as circular (FIG. 2) or oval (FIG. 6) or other provided that the inside dimension permits some lateral positioning of a replacement bumper guard and affords a concrete cavity on pour space between the substantially entire circumference of legs 13, 15 and base 14, 16 inner surface. Base 14, 16 can be made of any suitable material such as steel, cast iron, cast or extruded aluminum. If desired, base 14, 16 can be formed with upstanding ribs on fins 18 to better secure with the concrete foundation or roadway. One preferred embodiment of base 14, 16 includes a 7" inside diameter, circular cross section, one-eighth inch thick steel pipe section having four vertical steel fins, welded to the pipe generally as shown. Also, if desired, the inner walls of base 14, 16 can slope upward and outward to assure clean removal of hardened concrete 22 as described below.

According to a further feature of the present invention, concrete 22 is not allowed to adhere to the leg 13, 15 outer surface. In one embodiment, each base 14, 16 is first fitted with a liner or sock 20. Liner 20 is dimensioned to contact the substantially entire inner surface of base 14, 16 when concrete 22 is poured therein. Liner 20 is preferably tubular in shape and initially preferably has an upper end (represented by dashed lines 24) that extends above the upper end of base 14, 16. After concrete 22 is poured to fill the spaces between leg 13, 15 and base 14, 16, respectively, thus pressing liner 20 outward to the position best seen in FIG. 3, the upper end 24 of liner 20 can be cut or torn off or folded down below and outside the top edge of base 14, 16. Liner 20 can be made of any suitable material that will prevent concrete 22 from adhering to base 14, 16, such as polymer plastics, Nylon, canvas, etc. As seen below, liner 20 exits base 14, 16 with the withdrawal of hardened concrete 22 as described below.

System 10 in this condition can be held upright in a predetermined position on the foundation stone bed in the standard manner. Concrete forming the roadway, tarmac, or other vehicular driving surface or foundation 100 can be poured to a predetermined height equal to or slightly under the height of base 14, 16. See FIGS. 4 and 5.

If slightly under, the height dimension of base 14, 16 above the driving surface should be less than that in which impact to the bumper section that causes the legs 13, 15 to give way or bend would result in damage to the exposed part of base 14, 16.

Figure 3:
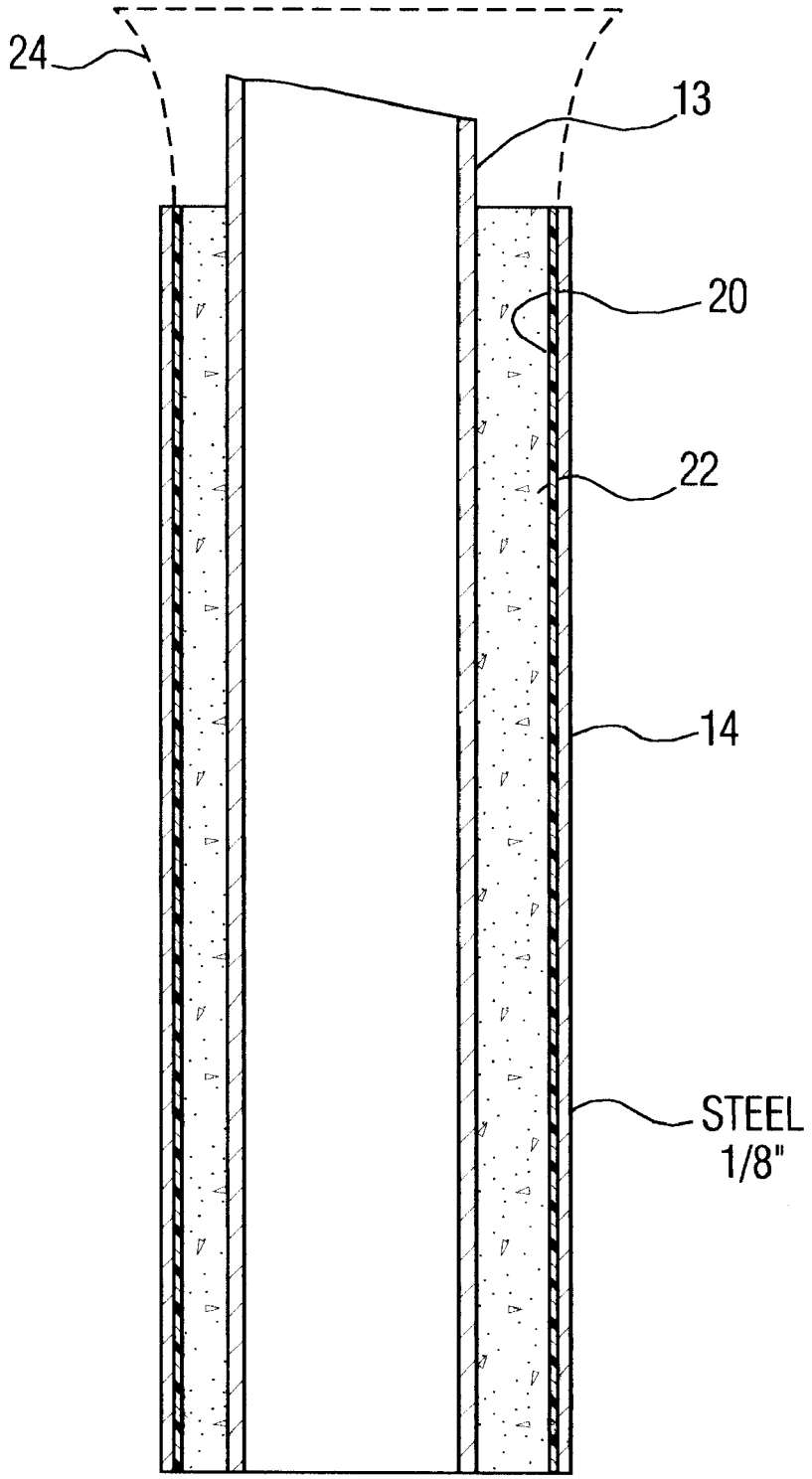
FIG. 3 is an enlarged partial view of the leg 13 and base 14 region of FIG. 1.
Figure 4:
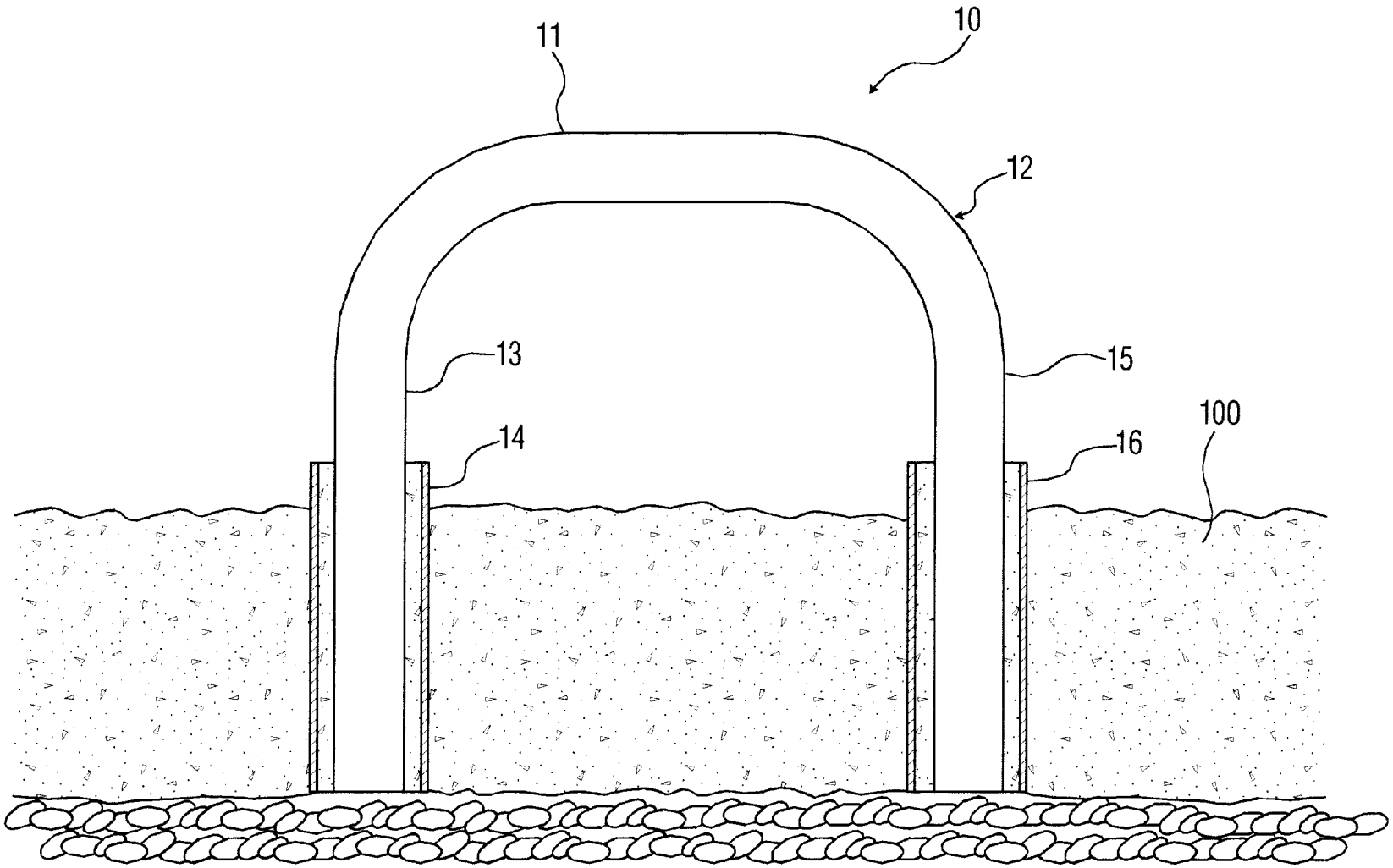
FIG. 4 is a vertical view taken along line 4—4 of FIG. 1 and showing the system after initial installation on a stone bed and within a foundation concrete layer.
Figure 5:
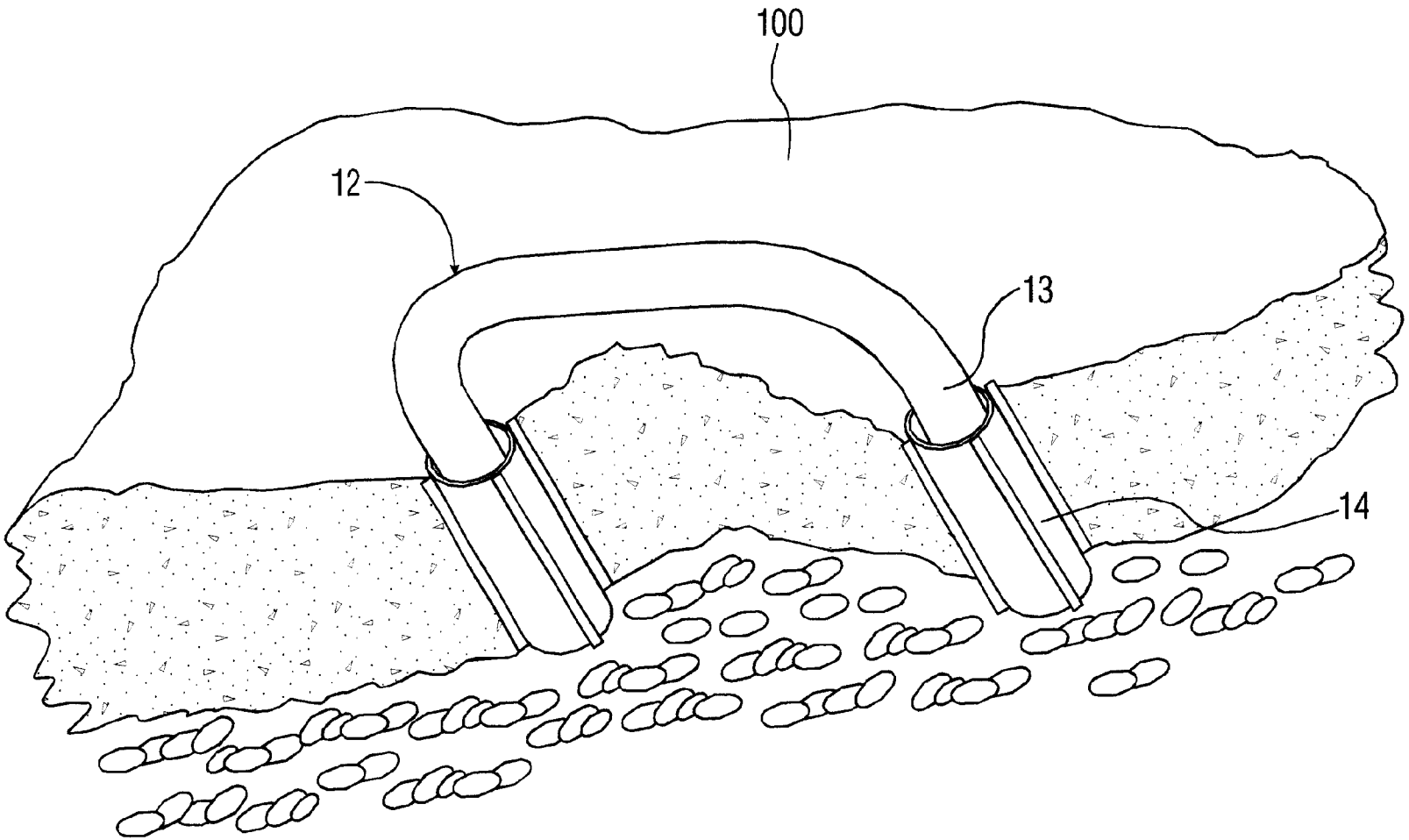
FIG. 5 is a perspective view of the system of FIG. 1 with the foundation concrete partially broken away.

In operation, System 10 can be factory assembled as shown in FIGS. 1 and 3 and shipped to the installation site as a unit. Or if preferred, the various parts can be shipped to the site for assembly at the installation site. In this latter case base 14, 16 is pre-positioned and concrete 100 poured to form the driving surface or foundation. Once concrete 100 is cured, liner 20 is placed into each base 14, 16 and bumper guard 12 installed with legs 13, 15 inserted into liners 20. Because base 14, 16 inner dimension, in this example, is greater than legs 13, 15 outer dimension, some horizontal lateral and fore-aft positioning of each leg 13, 15 is provided for. Once legs 13, 15 are properly positioned, concrete 22 is poured into liner 24, 20 to fill the space within base 14, 16 preferably surrounding leg 13, 15. If leg 13, 15 happens to touch the liner surface within base 14, 16 due to desired positioning, the system shall still function properly because impact forces shall be transmitted to and through base 14, 16 in the same manner as if concrete 20 were between base 14, 16 and leg 13, 15. Once concrete 22 fills to the top of base 14, 16, liner 24 portion can be cut or torn away to leave an appealing finish. Once all concrete sets, the installation is complete.

In the event of impact and damage to bumper 12 after installation, the operator can simply use a jack or tow-truck winch to lift bumper 12 straight up. Legs 13, 15 and concrete 22 simply lift out because concrete 22 had adhered to legs 13, 15 but, because of liner 20, had not adhered to base 14, 16 which base members remain secured within concrete 100. Once the damaged bumper and concrete 22 and liner 20 are removed, replacement liners 20 can be inserted in bases 14, 16 and a replacement bumper 12 with legs 13, 15 installs into liners 20 and bases 14, 16. Fore-aft and transverse leg 13, 14 positioning to proper location is followed by pouring new concrete 22 to secure the parts together as mentioned above.

Some of the advantages of the present System 10 include a quick and easy initial installation, a quick removal of the damaged bumper guard without disturbing the primary or foundation concrete 100 outside bases 14, 16, a rapid and efficient re-install of a new guard 12 with legs 13, 15 imbedded in replacement concrete 22 with bases 14, 16, and replacement liner 20 preventing concrete 22 from adhering to the base 14, 16 inside surface. Note bases 14, 16 function as permanent receptacles for replacement guards and parts, thereby avoiding the need to dig out or cut the foundation concrete 100 to achieve replacement.

Figure 7:
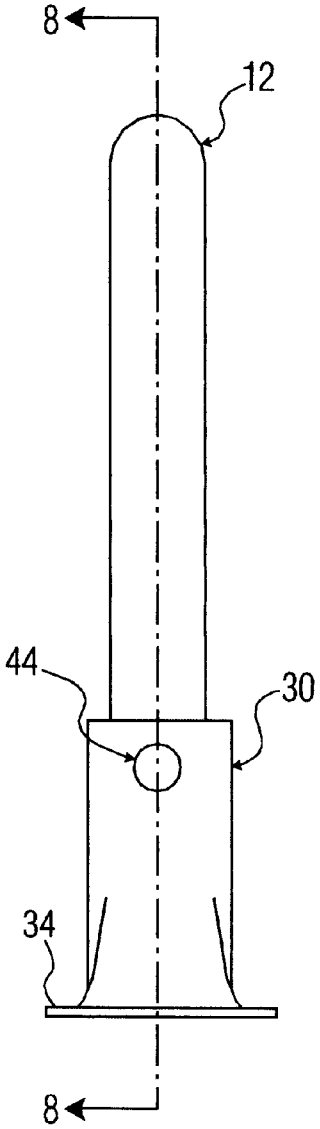
FIG. 7 is similar to FIG. 1 showing yet another alternate system embodiment according to the present invention.
Figure 8:
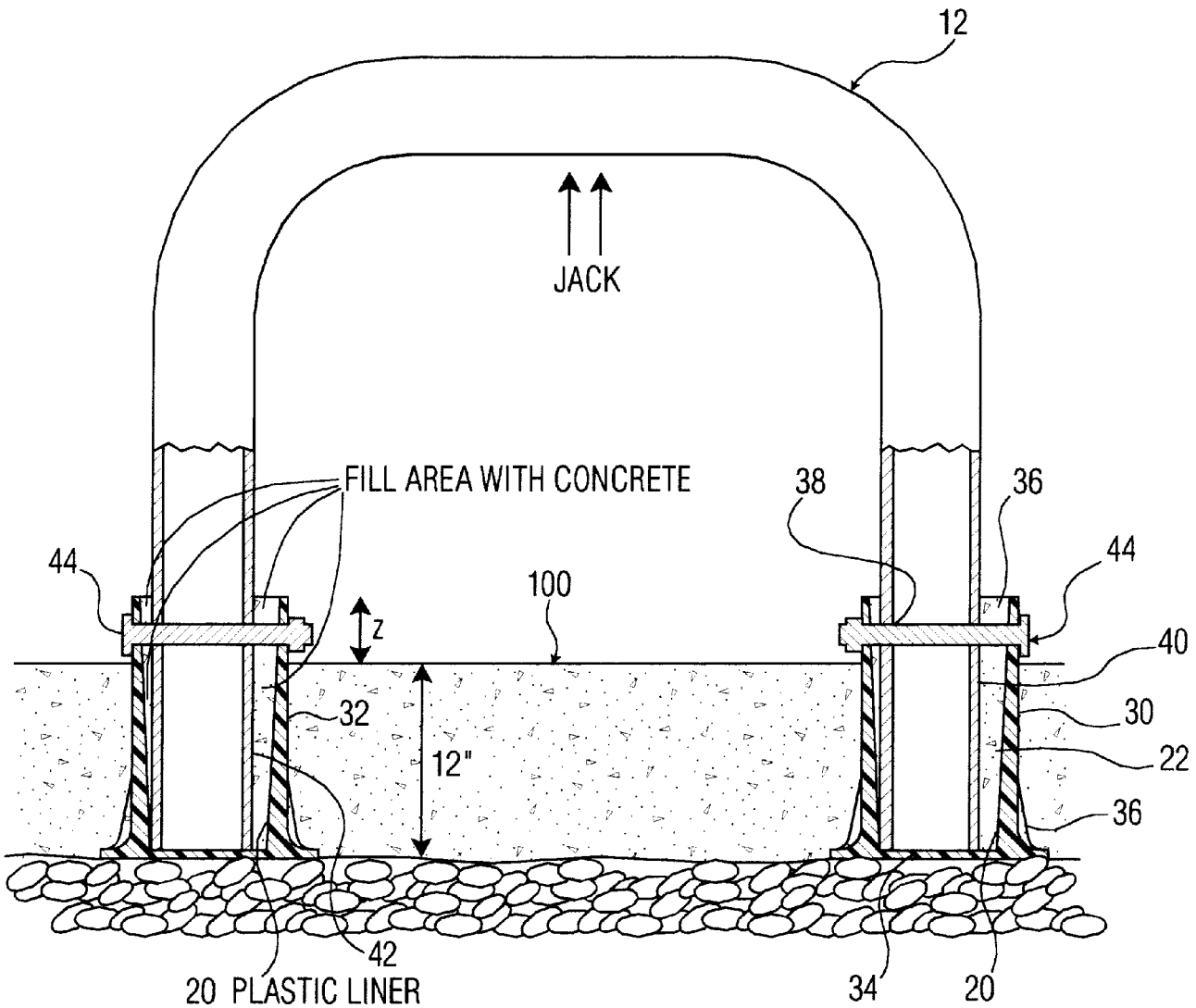
FIG. 8 is similar to FIG. 4 for the system embodiment of FIG. 7.

With reference to FIGS. 7–8, an alternate embodiment includes bases 30, 32, each including a bottom plate 34 extending beyond the base profile to form a footing and reinforcing ribs 36 to strengthen the base and transversely aligned through-holes 36 located a predetermined distance above the design level of the surrounding concrete foundation 100. For example, if the deigned height of the primary concrete is 12 inches, each base can be 14 inches in height with the through holes located there between corresponding holes 38 are drilled or formed in bumper guard legs 40, 42 and align with holes 36 when the parts are assembled. Bases 30, 32 are secured to legs 40, 42 by releasable bolt assemblies 44 before or after pouring concrete 22 within liner 20 as described above. However, in this embodiment, concrete 22 is poured to a level below assemblies 44 so that these assemblies can be released to permit withdrawal of legs 40, 42 following damage to bumper 12. Note, also that cavity walls of bases 30, 32 have a slight upward and outward extension to facilitate withdrawal of legs 40, 42 and concrete 22 that adheres to legs 40, 42. Operation of this embodiment is the same as that mentioned above except for the additional steps of securing and releasing bolt assemblies 44.

It will be understood that various changes and modifications can be made to the herein disclosed exemplary embodiments without departing from the spirit and scope of the present invention.

I claim:

1. A bumper guard system having a U-shaped guard with two spaced apart legs, each having an outer surface with an outer circumferential dimension at its distal end, and an interconnecting mid-section, the system comprising:

two, laterally spaced tubular base members being secured upright within a concrete or bituminous layer which layer defines a vehicular driving surface and has a predetermined height or thickness, each said base member inner surface surrounding the distal end of each respective leg, each said base member inner surface having an inside circumferential dimension greater than the outer dimension of its respective leg for forming a cavity substantially about each said distal end, and hardened, compression resistant material filling at least a portion of each said cavity to secure the respective leg within the respective base member, said material adhering to said outer surface of the respective one of said distal ends and not adhering to the inner surface of the respective one of said base members, each said material being separated from said layer by its respective base member, and wherein after installation in the layer, said legs can be lifted by applying vertical force thereto and said legs and said hardened material will rise out of the base members in response thereto.

2. A system as set forth in claim 1, wherein a liner is positioned between said hardened material and each said inner surface.

3. A system as set forth in claim 2, wherein said liner is made of a material that will not adhere to the hardened material.

4. A system as set forth in claim 3, wherein said hardened material is the type that can be poured into said cavities and allowed to set to become hardened.

5. A system as set forth in claim 1, wherein the vertical dimension of each base member approximates the designed thickness or vertical dimension of the layer in which it is secured.

6. A system as set forth in claim 1, wherein each base member includes ribs to assist in the securing of the base member within the layer.

7. A system as set forth in claim 1, wherein the circumferential dimension of the inner surface of each said base member increases toward the upward direction.

8. A system as set forth in claim 2, wherein after withdrawal of said hardened material and said legs from said base members, a new liner can be positioned within the cavity of each base member, the legs of a new U-shaped bumper guard can be placed within said cavities and said inner surface dimension being sufficiently greater than the outer surface dimension to enable each leg to be properly positioned transversely and fore-and-aft within the base member, and new material to be poured into the liner and cavity to harden and secure the respective new leg within the respective base member.

9. A system as set forth in claim 1, wherein a fastener secures each said leg to its respective base member.

10. A method of installing a U-shaped bumper guard within a layer of driving surface material, said method comprising, securing a pair of tubular shaped spaced base members within the layer, each said base member being secured in an upright position, before, during, or after said first securing step, positioning the distal end of one leg of the U-shaped bumper guard in each of the base members, and pouring material into the base member and in contact with the outer surface of the respective leg within each base member which material is of the type that can set, harden and adhere to the outer surface of such leg to secure the leg within the respective base member, and preventing the material from adhering to the inner surface of the base member.

11. A method of claim 10, wherein said preventing step includes lining the inner wall of the base members with a liner material that prevents the poured material from contacting the inner wall surfaces of the base members.

12. A method of installing an initial U-shaped bumper guard within a layer of driving surface material, withdrawing the initial guard from the layer, and re-installing a replacement guard within the layer, said method comprising, securing a pair of tubular shaped spaced base members within the layer, each said base member being secured in an upright position, before, during, or after said first securing step, positioning the distal end of one leg of the initial U-shaped bumper guard in each of the base members, and pouring material into the base member and in contact with the outer surface of the respective leg within each base member which material is of the type that can set, harden, and adhere to the outer surface of such leg to secure the leg within the respective base member, and preventing the material from adhering to the inner surface of the base member, said preventing step including lining the inner wall of the base members with an initial liner material that prevents the poured material from contacting the inner wall surfaces of the base members, after the material hardens, withdrawing the legs and the adhering material from the base members by applying upward forces thereto sufficient to lift the legs and hardened material free from the base members, positioning a replacement liner within each base member, positioning the legs of a replacement U-shaped bumper guard within the base members, pouring replacement compression resistant material that can harden into the base members so that the replacement material is in contact with and adheres to the outer surface of the replacement legs and the liner is positioned between the replacement material and the inner surfaces of the base members.

* * * * *